US008960950B2

(12) United States Patent
Risley, Sr. et al.

(10) Patent No.: US 8,960,950 B2
(45) Date of Patent: Feb. 24, 2015

(54) SURFACE MOUNT LUMINAIRE

(76) Inventors: James A. Risley, Sr., Bristol, PA (US); Randy K. Lewis, Spartanburg, SC (US); Wilton L. Fowler, Easley, SC (US); Martin C. Werr, Easley, SC (US); Robert J. Gotti, Edgewater Park, NJ (US)

( * ) Notice: Subject to any disclaimer, the term of this patent is extended or adjusted under 35 U.S.C. 154(b) by 484 days.

(21) Appl. No.: 13/299,150

(22) Filed: Nov. 17, 2011

(65) Prior Publication Data

US 2013/0128558 A1 May 23, 2013

(51) Int. Cl.

| | |
|---|---|
| ***F21V 21/00*** | (2006.01) |
| ***F21S 8/04*** | (2006.01) |
| ***F21V 15/01*** | (2006.01) |

(52) U.S. Cl.

CPC .. *F21S 8/04* (2013.01); *F21V 15/01* (2013.01)
USPC ..... 362/217.13

(58) Field of Classification Search

CPC ..... F21S 8/04
USPC ..... 362/217.13
See application file for complete search history.

(56) References Cited

U.S. PATENT DOCUMENTS

| | | | | |
|---|---|---|---|---|
| 3,235,989 | A | 2/1966 | Brooks | |
| 3,863,372 | A | 2/1975 | Stilling | |
| 4,267,657 | A | 5/1981 | Kloke | |
| 4,449,166 | A | 5/1984 | Sharp | |
| 4,630,386 | A | 12/1986 | Wilson | |
| 4,851,971 | A | 7/1989 | MacLagan | |
| 6,592,237 | B1 | 7/2003 | Pledger | |
| 2002/0191405 | A1* | 12/2002 | Sieczkowski | 362/404 |
| 2007/0211457 | A1* | 9/2007 | Mayfield et al. | 362/223 |

FOREIGN PATENT DOCUMENTS

| | | |
|---|---|---|
| DE | 32438883 | 5/1984 |
| JP | 54-115574 | 9/1979 |
| JP | 2009-123545 | 6/2009 |
| WO | 95/30979 | 11/1995 |

* cited by examiner

*Primary Examiner* — Anh Mai
*Assistant Examiner* — Hana Featherly
(74) *Attorney, Agent, or Firm* — Michael Best & Friedrich, LLP

(57) ABSTRACT

A lighting fixture includes a housing formed from walls that are connected by corner posts that are inserted into the ends of the walls eliminate light leaks and external fasteners. The corner posts include barbs or screw holes for receiving screws from the inside of the walls. The housing can be used as a retrofit for a recessed lighting fixture where the housing can surround the lighting fixture and attach thereto. The assembly can then be mounted by a suitable support.

17 Claims, 8 Drawing Sheets

SURFACE MOUNT LUMINAIRE

FIELD OF THE INVENTION

The present invention is directed to a surface mounted luminaire. The invention is particularly directed to a housing that can be attached to a recessed luminaire so that the luminaire can be mounted to a surface and to retrofit the luminaire.

BACKGROUND OF THE INVENTION

Various methods of constructing luminaires and housing for luminaires are known. One common method is to form walls from various panels that are connected by screws or other fasteners. These assemblies typically result in light leaks at the corners of the assembly.

U.S. Pat. No. 3,235,989 to Brooks discloses the general concept of a frame for an illuminated sign where the frame is formed from four panels connected together by L-shaped brackets. The brackets are attached to the frame panels by screws and bolts.

U.S. Pat. No. 3,863,372 to Stilling discloses a sign box where the frame is assembled from panels and L-shaped gusset members. The gusset members have two legs with a plurality of teeth for engaging a recess in the side panels to secure the panels together.

U.S. Pat. No. 4,267,657 to Kloke discloses an illuminated sign where the side panels of the frame are assembled using an L-shaped corner piece. The corner piece includes legs having a plurality of teeth to engage the inner surfaces of the corner panels.

U.S. Pat. No. 4,449,166 to Sharp discloses a lighting fixture and air flow support system including a surrounding frame for forming an air supply. The frame includes side panels that are connected together by an L-shaped corner piece. The corner piece is received in the open ends of the respective panels and secured by screws passing through the walls of the side panels.

U.S. Pat. No. 4,630,386 to Wilson discloses a reversible picture frame where the frame is constructed from side panels connected together by an L-shaped corner member having teeth for engaging the surfaces of the frame.

U.S. Pat. No. 4,851,971 to MacLagan discloses a transparency illuminator having a frame formed from four panels where the panels are connected together by L-shaped corner members 86 as shown in FIG. 4.

U.S. Pat. No. 6,592,237 to Pledger discloses a panel frame for providing ventilation to a lighting fixture. The panel frame as shown in FIG. 8 includes four panels coupled together by lugs 40 extending from one end of each of the panels. The lugs engage dimples 50 to connect the panels together.

WO 95/30979 discloses an illuminated display sign having an outer frame formed from panels coupled together by an L-shaped bracket.

JP 54-115574 discloses a housing formed from extruded panels that are coupled together by L-shaped clip members 9. The panels include grooves that engage the coupling member 6.

JP 2009-123545 discloses a picture frame having a lighting device inside the frame. The frame includes four extruded panels coupled together by an L-shaped corner member.

DE 32 43 8883 discloses a corner connection for a lighting fixture. The lighting fixture includes corner members for connecting a plurality of panels together for assembling a plurality of lighting fixtures together.

While various prior assemblies are generally suitable for their intended use, there is a continuing need for improved lighting assemblies and luminaires.

SUMMARY OF THE INVENTION

The present invention is directed to a surface mounted luminaire. The invention is particularly directed to a housing for a luminaire that does not exhibit light leaks in the corners of the housing.

The housing of the luminaire is formed by side walls having an opening at each end. An L-shaped corner post is inserted into the open ends to secure the walls together.

One feature of the invention is to provide a housing having walls connected together by a corner post where the corner post has barbs or hooks that connect to walls.

Another feature of the invention is to provide a luminaire formed from side walls and a corner post where the corner posts are coupled to the walls by screws, rivets, barbs, hooks, or other fasteners.

A further feature of the invention is to provide a retrofit assembly for a recessed luminaire to adapt the recessed luminaire to for surface mounting.

Another feature of the invention is to provide a housing for a luminaire having an adjustable mounting bracket that can be moved along the length of the housing to a selected position.

The various features of the invention are basically attained by providing a lighting assembly comprising a lighting fixture adapted for mounting in a ceiling to define a recessed lighting fixture. The lighting fixture has a first end wall, a second end wall, and a reflector extending between the end walls and defining a downwardly open chamber. A top member is coupled to the first and second end walls and a lamp base for supporting a lamp in the open chamber for directing light in a downward direction with respect to the lighting fixture. A mounting member is adapted for mounting the lighting fixture to a ceiling. A housing surrounds the lighting fixture and a coupling member for coupling the lighting fixture to the housing. The housing has a first end wall, a second end wall, a first side wall and second side wall. The first and second side walls extend between the end walls. The housing has a top surface adapted for surface mounting to a ceiling.

The features of the invention are also attained by providing a surface mounted lighting assembly comprising a lighting fixture having a first end wall, a second end wall, a ballast channel and at least one reflector. The ballast channel extends between the end walls, top face, and a lamp base for supporting at least one lamp for directing light in a downward direction with respect to the lighting fixture. The lighting fixture is a self-contained assembly adapted for use as a recessed lighting fixture. A housing has a first end wall and a second end wall, a first side wall and a second side wall. The first and second side walls are coupled to the end walls and define an internal cavity. The lighting fixture is positioned within the housing and are coupled thereto for supporting the lighting fixture within the housing.

The features of the invention are also attached by providing a method of retrofitting a recessed lighting fixture to a surface mount lighting fixture. The method comprises the steps of providing a lighting fixture adapted for mounting in a ceiling in a recessed position. The lighting fixture has a first end wall, a second end wall, a reflector extending between the first and second end walls, and is adapted for supporting a lamp holder for receiving a lamp. The lighting fixture is positioned in a housing and couples the lighting fixture to the housing. The housing has a first end wall, a second end wall, a first side wall and a second side wall. The first and second side walls extend between the end walls. The housing has an open top end adapted for surface mounting to a ceiling and an open bottom end.

These and other aspects of the invention will become apparent from the following detailed description of the invention which, in connection with the annexed drawings, disclose various embodiments of the invention.

BRIEF DESCRIPTION OF THE DRAWINGS

The following is a brief description of the drawings, in which.

DETAILED DESCRIPTION OF THE INVENTION

The present invention is directed to a luminaire assembly that can be mounted to a surface or suspended from a ceiling surface. The invention is particularly directed to a housing for a luminaire that can be adapted for a recessed lighting fixture for surface mounting the luminaire.

Figure 1:
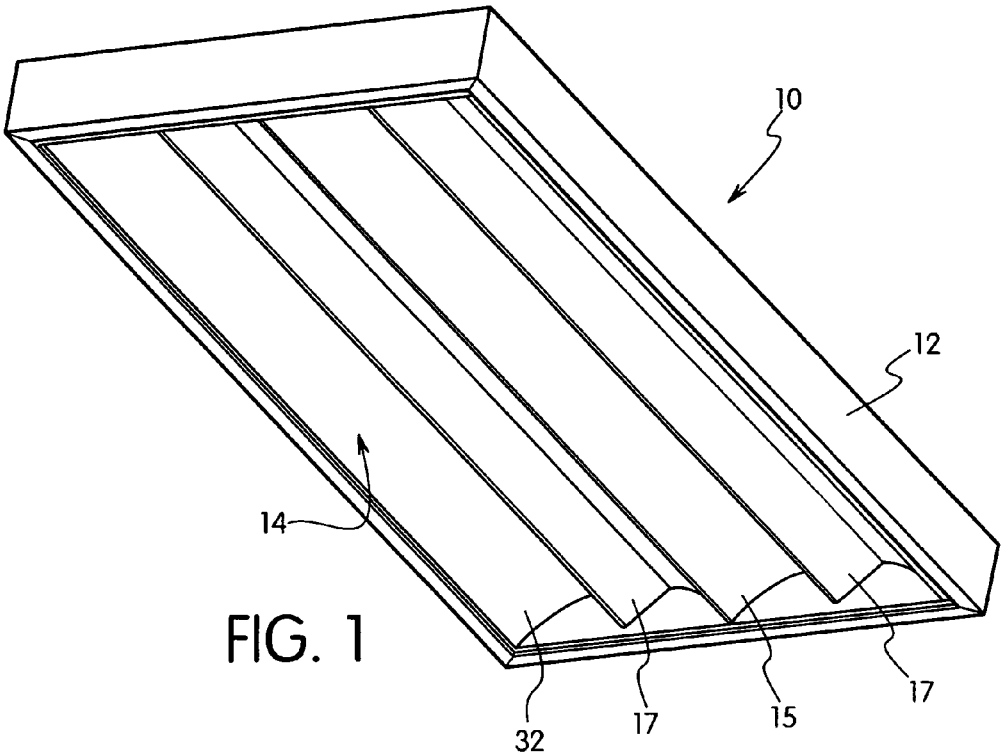
FIG. 1 is a bottom perspective view of the luminaire in a first embodiment of the invention.

Referring to FIG. 1, FIGS. 1-7 show a first embodiment of the invention including a luminaire assembly 10 having a housing 12 and a light fixture 14. As shown in FIG. 1, the light fixture 14 is mounted within the housing 12.

Figure 2:
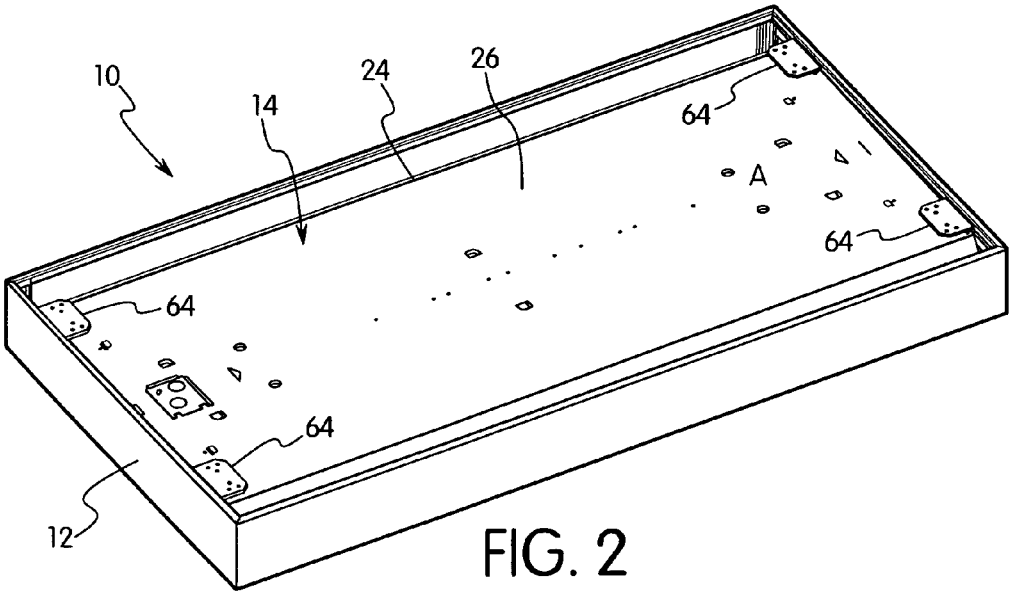
FIG. 2 is a top view of the luminaire of FIG. 1.
Figure 3:
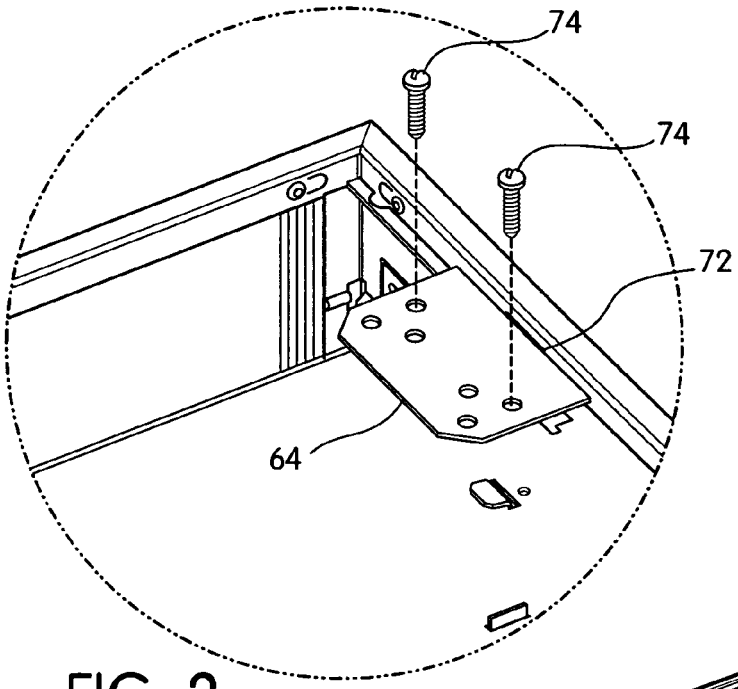
FIG. 3 is an enlarge perspective view of the corner of the luminaire of FIG. 1.

The housing 12 as shown in FIG. 2 includes side walls 16 and end walls 18 connected together to form a rectangular housing. The light fixture 14 is received within the opening of the housing 12 and coupled to the housing. The housing 12 in the embodiment shown has an open bottom end and an open top end defined by the side walls 16 and the end walls 18. A coupling member 64 is coupled to the housing along a top edge for coupling to the top wall of the light fixture as shown in FIG. 3. The light fixture can be attached to the coupling member 64 by screws or other fasteners.

The light fixture 14 in the embodiment shown includes an outer housing 24 having a top wall 26, end walls 28 and side walls 30. As shown in FIG. 1, reflectors 32 are provided within the housing 24 for directing light in a downward direction. The light fixture 14 is preferably an assembled unit containing a ballast within the center cover 15, and suitable electrical wiring and lamps within the lens 17. In a preferred embodiment of the invention, the lighting fixture 14 is a recessed luminaire as known in the art that is adapted for mounting in a ceiling on various T-bar supports or other supporting structure. The recessed lighting fixture is preferably constructed so that the open bottom end lies flush with the bottom surface of the ceiling panel.

In one embodiment of the invention, the assembly 10 is adapted for retrofitting recessed lighting fixtures 14 for surface mounting or suspending from a ceiling. The housing 12 is constructed to enclose the lighting fixture 14 and to support the lighting fixture. The assembly 10 can then be attached to a ceiling or other surface directly or through various support structures.

Figure 5:
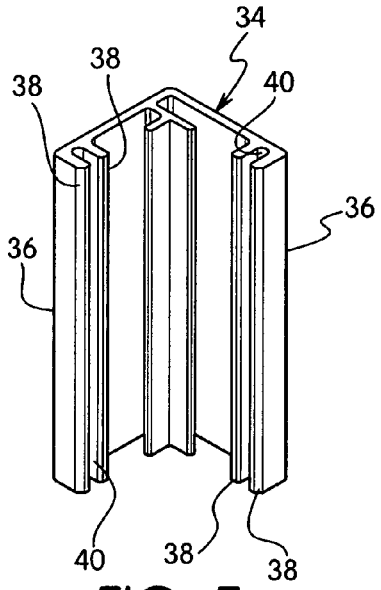
FIG. 5 is a perspective view of a corner post in one embodiment of the invention.

The housing 12 is preferably constructed from side walls 16 and end walls 18 that are connected together by a corner post 34 as shown in FIG. 5. In the embodiment of FIG. 5, the corner post 34 is an extruded aluminum member having a substantially L-shape formed by two perpendicular legs 36. Each leg 36 includes inwardly extending ribs 38 defining a longitudinal groove or slot 40.

Figure 12:
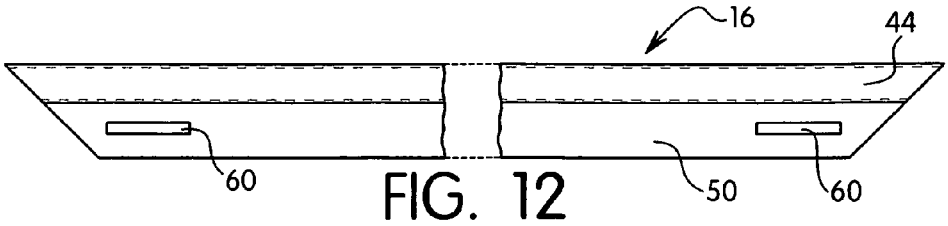
FIG. 12 is a top view of the wall sections in one embodiment of the invention.
Figure 13:
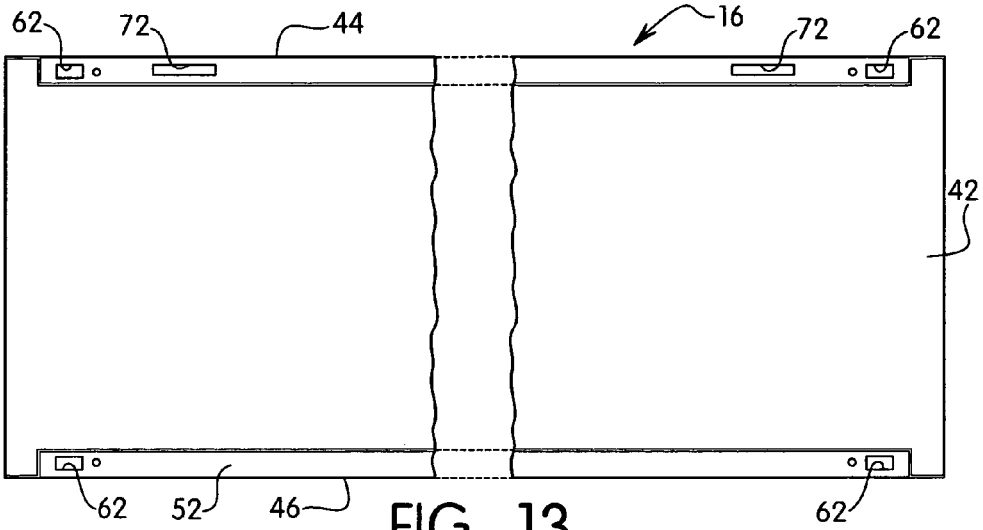
FIG. 13 is a side view of the wall of FIG. 12.
Figure 14:
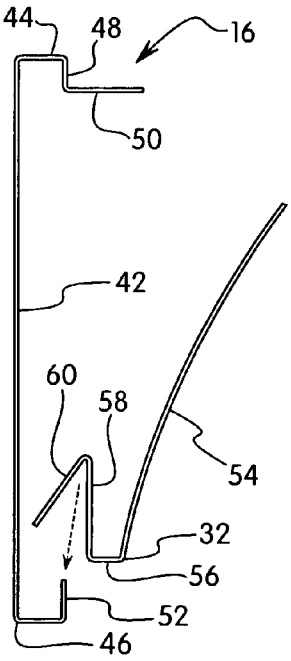
FIG. 14 is an end view of the wall of FIG. 12 showing the reflector coupled to the wall.

Referring to FIGS. 12 and 13, the side walls 16 are shown. In a preferred embodiment of the invention, the side walls 16 and end walls 18 are substantially the same except for the longitudinal length. Thus, the end wall 16 is shown for clarity although it will be understood that the end and side walls are constructed in a similar manner. Referring to FIG. 14, side wall 16 has an outer wall 42 defining the height of the housing with a top end 44 and a bottom end 46. As shown in FIG. 14, the top end 44 extends inwardly perpendicular from the plane of the outer wall 42. The bottom end 46 also extends inwardly perpendicular from the outer wall 42 a distance corresponding to the width of the top end. The top end 44 has a downwardly extending portion 48 and an inwardly extending flange 50. The bottom end 46 has an upwardly extending lip 52. As shown in FIG. 14, the ends of the side and end walls define a channel for receiving the legs of the corner post.

Figure 15:
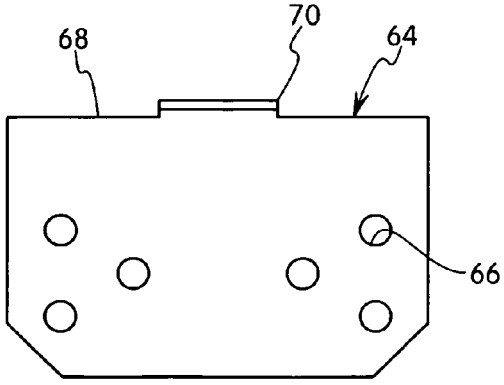
FIG. 15 is a top view of the coupling bracket.

As shown in FIG. 15, the upwardly extending lip 52 has a dimension to mate with the outer edge of the reflector 32 to connect the reflector to the bottom end of the side wall. As shown in FIG. 14, the reflector in the embodiment illustrated has a curved portion 54 terminating with an outwardly extending portion 56. An upwardly extending portion 58 extends from the outer edge of the outwardly extending portion 56. A downwardly extending hook portion 60 extends at an incline with respect to the upwardly extending portion 58 for hooking onto the lip 52 and supporting the reflector and luminaire.

Figure 4:
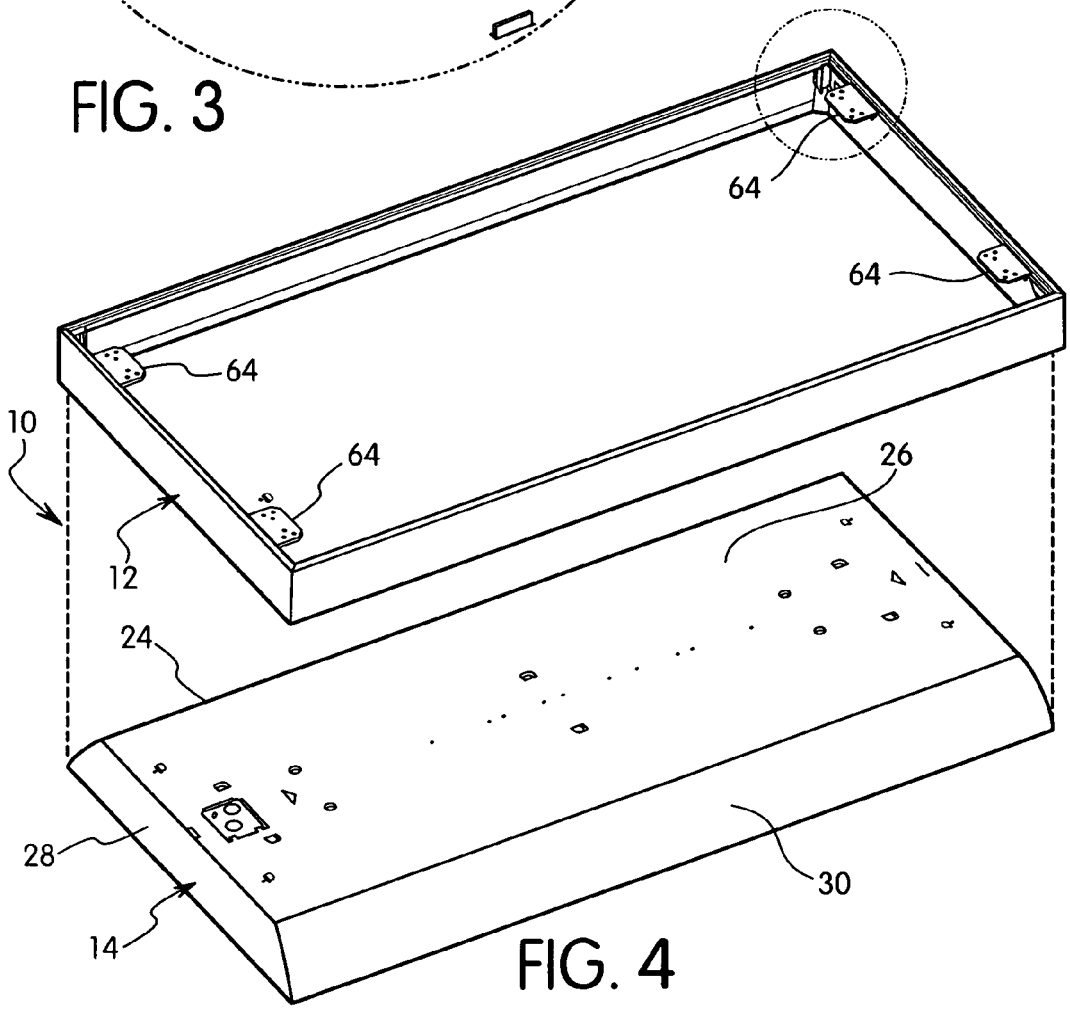
FIG. 4 is an exploded view of the luminaire showing the housing and the lighting fixture.

Referring to FIG. 12, the inwardly extending flange 50 includes one or more longitudinal slots 60. In the embodiment shown, the slots 60 are positioned towards the longitudinal ends of the side walls and end walls. The side walls and end walls are angled at about 45 degrees as shown in FIG. 4 to form a mitered corner between the side walls and the end walls. The downwardly extending portion 48 and the lip 52 as shown in FIG. 13 include an opening or tab 62. The coupling tab 62 is cut from the side wall along three sides to form a bendable tab that can be bent inwardly to couple with the corner post.

Figure 16:
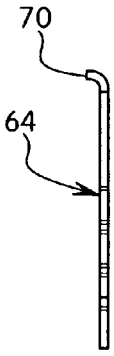
FIG. 16 is an end view of the bracket of FIG. 15.

A coupling bracket member 64 shown in FIG. 4 and FIGS. 15 and 16 is provided for coupling the light fixture 14 to the housing 12. As shown in FIG. 15, the coupling bracket 64 has a planar configuration with a plurality of screw holes 66. A side edge 68 includes a bent tab 70 that extends substantially perpendicular to the plate of the coupling bracket 64. The tab 70 has a dimension to be received within the slots 60.

In one embodiment, the end walls and side walls of the housing 12 include a longitudinal slot 72. The tab 70 of the mounting bracket 64 has a dimension to be received within the slot 72. As shown in FIG. 3, the tab 70 is inserted into the slot 72 in the end wall so that the tab hooks to the end wall. Screws 74 are then passed through the screw hole 66 and into the top wall of the light fixture for coupling the light fixture to the housing.

Figure 6:
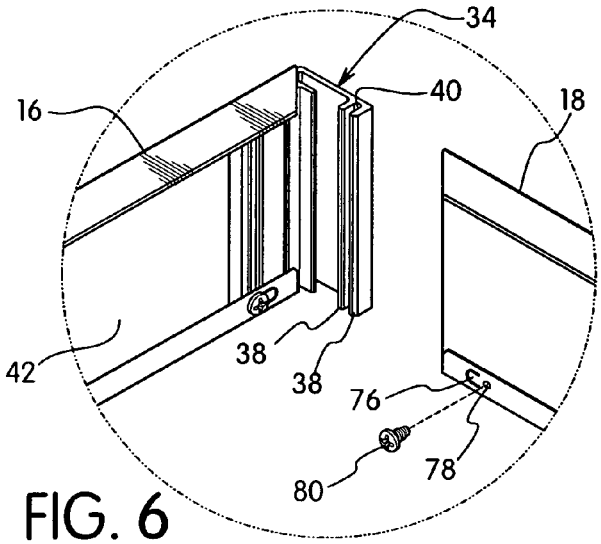
FIG. 6 is a partial perspective showing the assembly of the walls to the corner post using screws.
Figure 7:
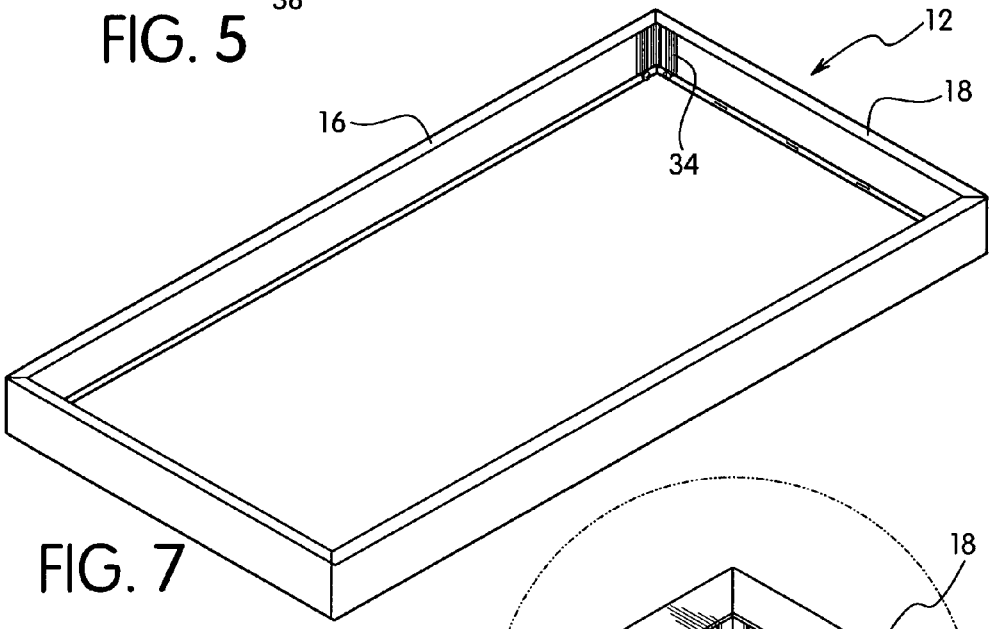
FIG. 7 is a perspective view of the housing in the assembled condition.

The side walls and end walls of the housing can be coupled to the corner post by various methods. In the embodiment shown in FIG. 6, the side walls 16 and end walls 18 have a bendable tab 76 cut from the inner surface of the wall and a screw hole 78. The corner post is inserted into the end of the side walls and end walls. The screws 80 are then threaded through the screw holes 78 and into the longitudinal slot 40 for coupling the side walls and end walls to the corner post as shown in the assembly of FIG. 7.

Figure 8:
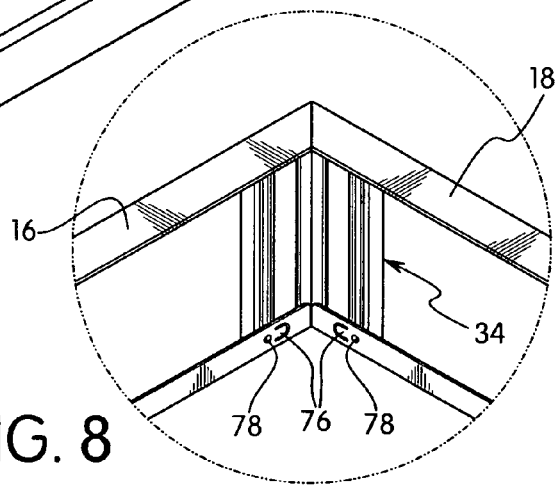
FIG. 8 is a perspective view of the corner of the luminaire showing the walls connected to the corner post by inwardly bent tabs.
Figure 9:
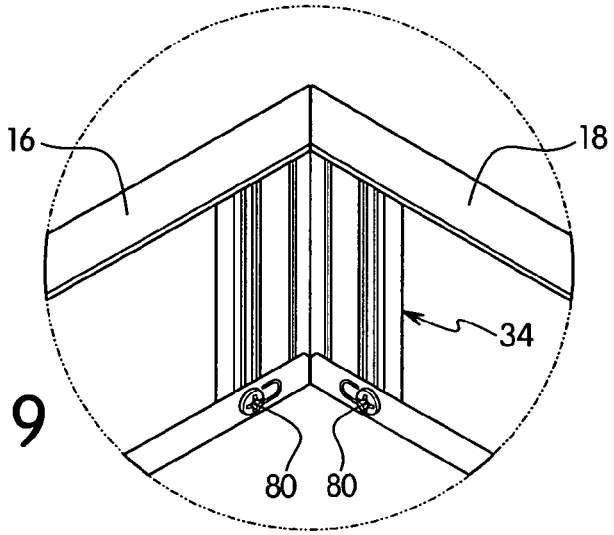
FIG. 9 is a perspective view of the corner showing the walls connected to the post by screws and tabs.
Figure 10:
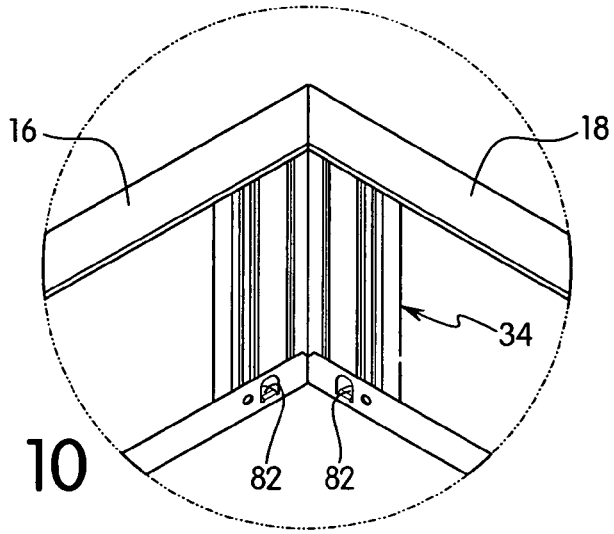
FIG. 10 is a perspective view of the corner showing the walls connected to the post by tabs that are bent along a horizontal line of the walls.
Figure 11:
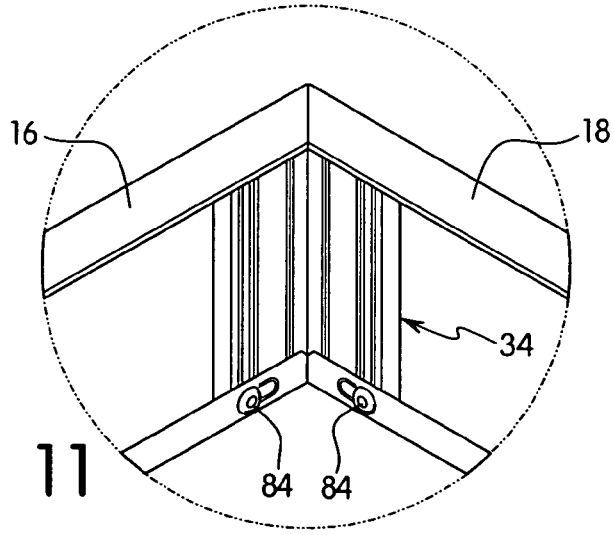
FIG. 11 is a perspective view of the corner showing the walls connected to the corner posts by rivets.

As shown in FIG. 8, the side walls and end walls can also be coupled to the corner post by bending the tabs 76 inwardly into engagement with the longitudinal slot 40. FIG. 9 also shows the side walls and end walls connected to the post by screws threaded through the screw holes 78. In other embodiments, the side walls and end walls can have a tab 82 cut from the respective side wall and end wall that can be bent along a horizontal line parallel to the bottom edge of the side walls and end walls. The tabs 82 are bent inwardly into engagement with the longitudinal slot 40 in the corner post 34 as shown in FIG. 10. In another embodiment, a rivet 84 can be inserted through the screw hole 78 to attach the side walls and end walls to the corner post. In preferred embodiments, the side walls and end walls have a suitable hole and/or tab along the top edge and the bottom edge to provide secure coupling to the corner post. In still other embodiments, the top and bottom portions of the side and end walls can have bendable tabs or screws for coupling with the corner posts.

Figure 17:
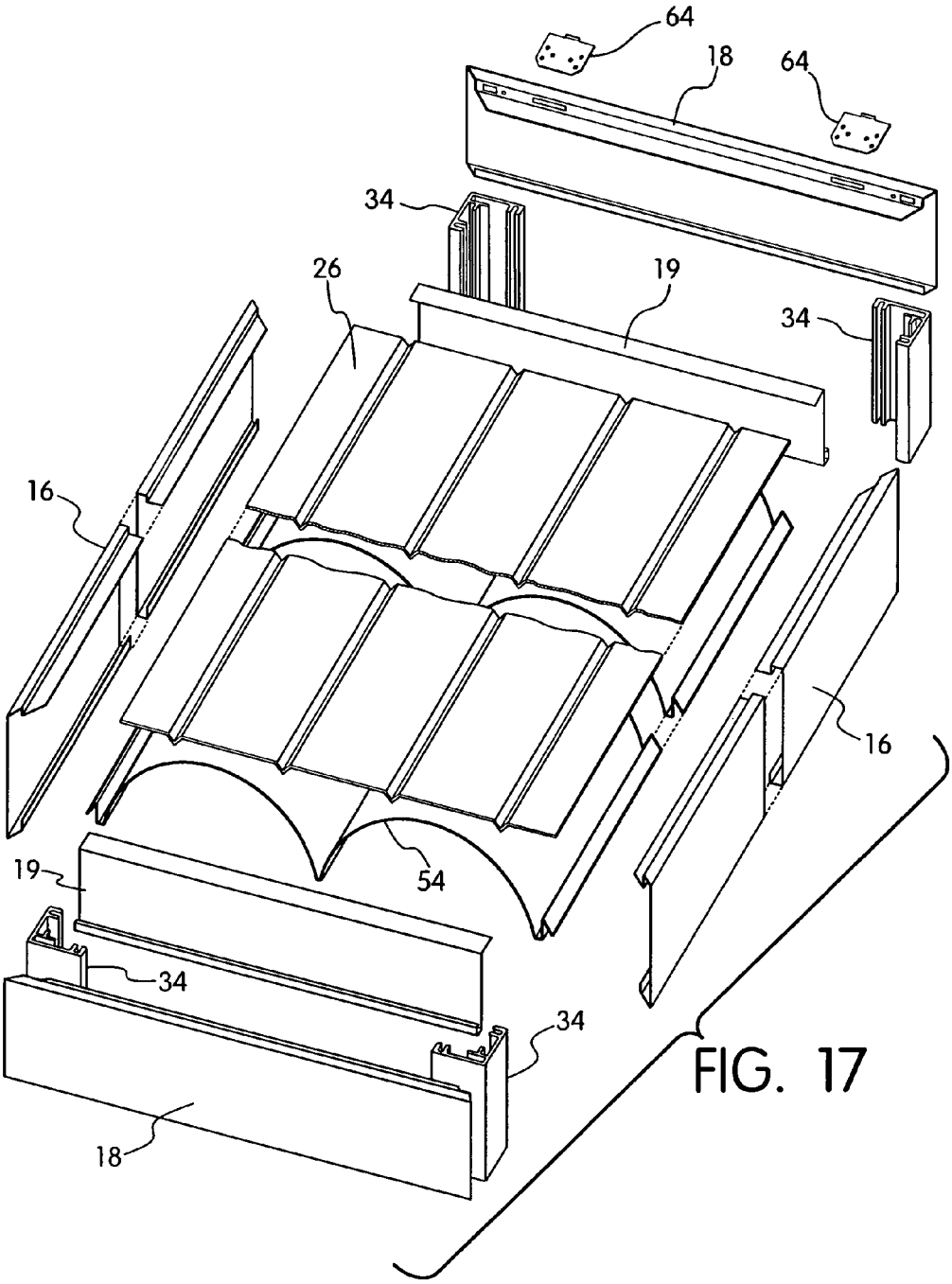
FIG. 17 is an exploded view of the assembly in another embodiment of the invention.

The corner post 34 and the mitered ends of the side walls and end walls provide a uniform and closed housing. The corner posts preferably have a longitudinal length corresponding to the height of the side walls and end walls as shown in FIG. 6. Preferably, the corner posts do not have openings that allow light to escape between the mitered seam between the side walls and the end walls. FIG. 17 is an exploded view of the luminaire assembly showing the side and end walls coupled to the luminaire. As shown in FIG. 17, inner end walls 19 can be attached to the end walls 18. The inner end walls 19 can also be formed as end walls of the luminaire.

Figure 18:
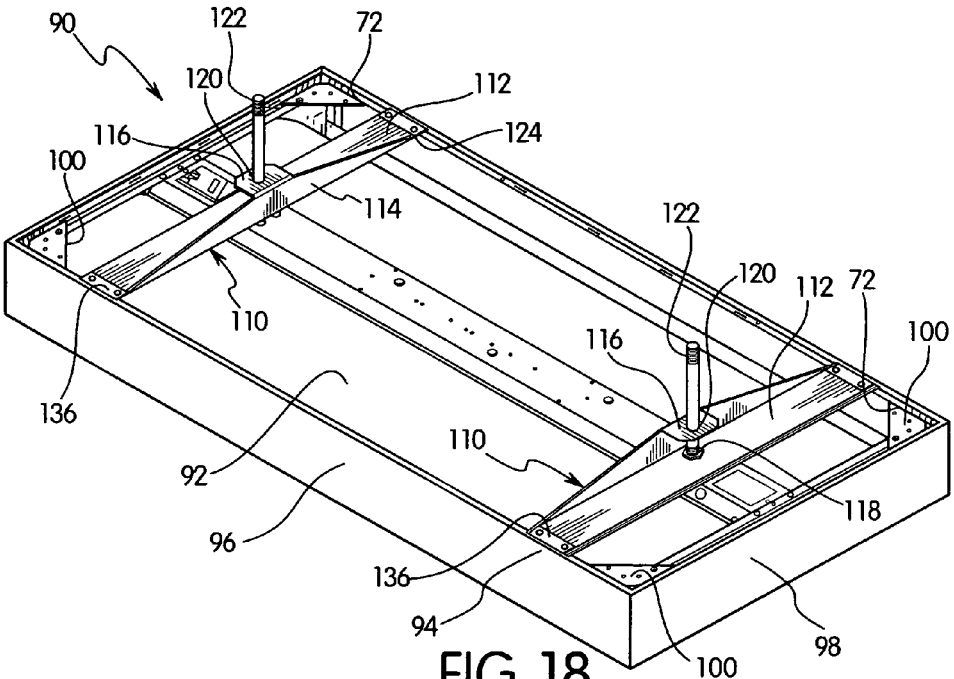
FIG. 18 is a top perspective view of another embodiment showing the mounting support.

Referring to FIG. 18, another embodiment of the invention is shown. The assembly 90 of FIG. 18 includes a luminaire 92 and housing 94. The luminaire 92 as in the previous embodiment, is preferably a luminaire suitable for mounting as a recessed assembly within a ceiling or surface so that the open bottom end of the luminaire is flush with the surface of the ceiling. The housing 90 includes side walls 96 and end walls 98. The side walls 96 and end walls 98 are constructed substantially the same as in the embodiment of FIGS. 12-14.

Figure 20:
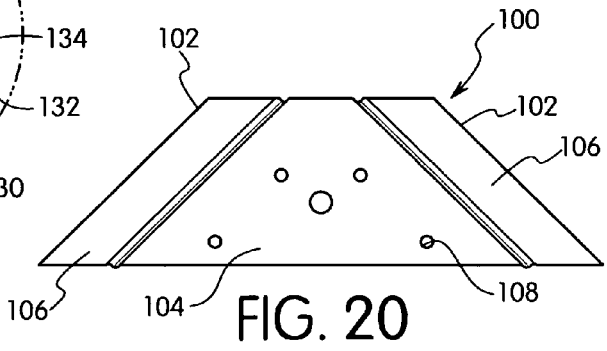
FIG. 20 is a top view of the corner bracket.
Figure 21:
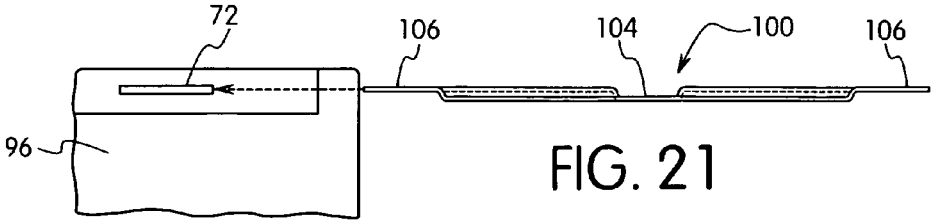
FIG. 21 is an end view of the corner bracket of FIG. 20.

In this embodiment, a corner support member 100 is coupled to the side walls and end walls to strengthen the housing. As shown in FIGS. 20 and 21, the corner member 100 has a substantially triangular shape with angled longitudinal ends 102. The angled ends 102 form an angle of approximately 90 degrees for mating with the respective side wall and end wall. As shown in FIG. 21, the ends 102 are bent out of the plane of the body 104 and extend parallel to the body 104 to define a tab 106. The tabs 106 are inserted into the slots 72 to couple the side walls and end walls together. The side walls and end walls are also coupled together by a suitable corner post as in the previous embodiment. The body 104 of the corner member includes a plurality of holes 108 that are adapted for receiving screws or other fasteners. The screws or fasteners can extend through the body and into the luminaire housing for coupling the luminaire to the housing.

In the embodiment of FIG. 18, the assembly includes a mounting or hanger structure 110 for suspending the assembly. The hanger 110 has a bottom wall 112 with a width to extend between the opposite side walls as shown. An upwardly extending side wall 114 extends perpendicular from the bottom wall. An inwardly extending flange 116 extends perpendicular from the side wall 14. The bottom wall includes a hole 118 and the flange 116 includes a hole 120 for receiving a support rod 122. The rod 122 can be solid or hollow for supplying wiring to the luminaire. The rod 122 is adapted for coupling to the hanger 110 and the a bracket or other support surface to suspend the lighting assembly 90. The rod can also extend through the hanger and attach directly to the luminaire to support the luminaire and housing. The end walls of the housing can be attached to the top surface of the luminaire by screws extending downwardly through the lip of the end walls as shown in FIG. 18.

Figure 19:
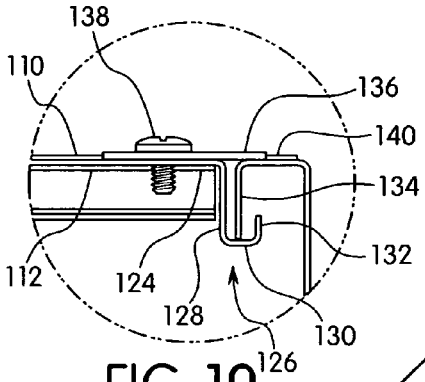
FIG. 19 is a partial cross-sectional view showing the support connected to the side walls of the luminaire.

Referring to FIG. 19, the bottom wall 112 of the hanger has an outer end 124 with a downwardly extending lip 126. The lip 126 has a downwardly extending portion 128 and an outwardly extending portion 130 parallel to the plane of the bottom wall and an upwardly extending flange 132 to define a hook-shaped end. The hook-shaped end as shown in FIG. 19 hooks onto the downwardly extending lip 134 of the side wall. In this manner, the lip 126 hooks onto the side wall to support the assembly. A coupling plate 136 is attached to the end of the bottom wall 112 by screws 138. The plate 136 has a length to overlie the lip 126 and the top surface 140 of the side wall to securely couple the hanger 110 to the side wall. The screws 138 can be loosened to allow the hanger to slide along the longitudinal length of the side walls to adjust the position of the hanger with respect to the side wall. The screws are then tightened to securely position the hangers in the desired location.

Figure 22:
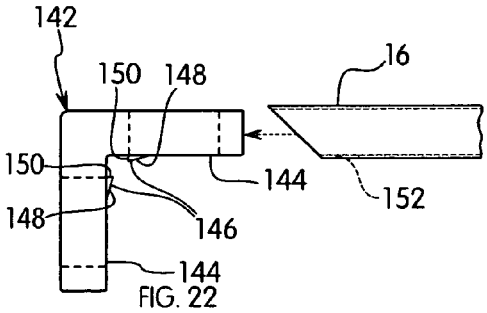
FIG. 22 is a top view of the corner post in another embodiment of the invention.
Figure 23:
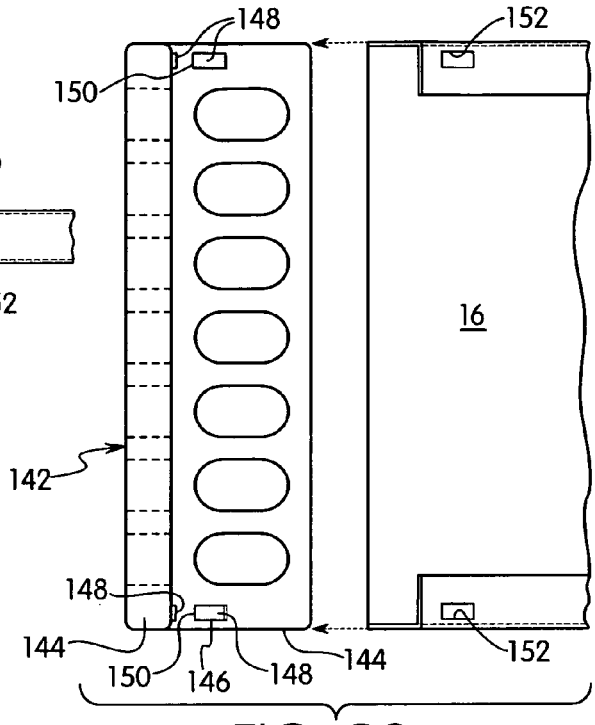
FIG. 23 is a side view of the corner post of the embodiment of FIG. 22.

In the previous embodiment, the corner posts are connected to the side walls and end walls by screws, rivets or tabs. In another embodiment, the corner posts can be connected by hooks on the corner posts. Referring to FIGS. 22 and 23, the corner post 142 has a substantially L-shape as in the previous embodiment. Each leg 144 has an inwardly extending hook portion 146 at the top and bottom edges. The hook portion 146 has an inclined surface 148 to slide into the respective side wall and end wall and an end surface 150 perpendicular to the plane of the respective leg to hook into a slot 152 in the side wall 154.

Figure 24:
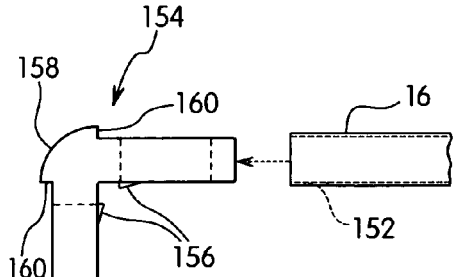
FIG. 24 is a top view of the corner post in a further embodiment of the invention.
Figure 25:
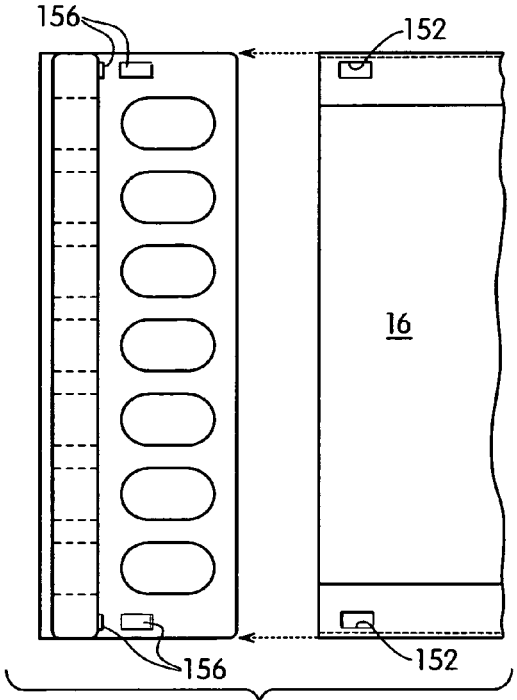
FIG. 25 is a side view of the corner post of FIG. 24.

In another embodiment shown in FIGS. 24 and 25, a similar corner bracket 154 is shown. The bracket 154 includes inwardly extending hook portions 156 in the same manner as the embodiment of FIG. 22. In this embodiment, the outer corner of the L-shaped corner post has a curved profile 158 and a lip 160. In this embodiment, the side walls are not mitered and have the ends cut perpendicular to the plane of the side walls. The side walls are snapped onto the corner post so that the ends of the side walls abut the lip 160 to form a smooth outer corner.

The housing of the invention is particularly suitable for retrofitting a recess luminaire for surface mounting. One aspect of the invention provides a method for retrofitting a recessed lighting fixture or luminaire. The housing is assembled around the luminaire so that the luminaire is supported by the housing.

While various embodiments have been chosen to illustrate the invention, it will be understood by those skilled in the art that various changes and modifications can be made without departing from the scope of the invention as defined in the appended claims.

What is claimed is:

1. A lighting assembly comprising:

a lighting fixture adapted for mounting in a ceiling to define a recessed lighting fixture, said lighting fixture having a first end wall, a second end wall, a reflector extending between said end walls and defining a downwardly open chamber, a top wall coupled to said first and second end walls adapted for supporting a lamp base and a lamp in said open chamber for directing light in a downward direction with respect to said lighting fixture; and a housing surrounding said lighting fixture and a coupling bracket for coupling said top wall of said lighting fixture to said housing, said housing having a first end wall, a second end wall, a first side wall and second side wall, said first and second side walls extending between said end walls, said end walls having an inwardly facing slot at a top end of said housing, said housing having a top surface adapted for surface mounting to a ceiling and said coupling bracket being coupled to said top wall of said lighting fixture, said coupling bracket having a side edge with a first tab received in said slot for coupling said housing to said lighting fixture.

2. The lighting assembly of claim 1, wherein said side walls of said housing include a slot on an inner surface and where said coupling bracket has a second tab received therein and where said first tab and said second tab are substantially perpendicular and substantially parallel to each other.

3. The lighting assembly of claim 1, wherein said side walls of said housing have a top end with an inwardly extending top lip and a bottom end with an inwardly extending bottom lip defining an upwardly facing recessed portion, and where said reflector of said lighting assembly has two opposite bottom side edges received in a respective recessed portion of said housing for supporting said lighting fixture.

4. The lighting assembly of claim 3, further comprising a hanger mounting bracket for hanging said lighting assembly, said mounting bracket having a bottom hook portion for engaging a bottom surface of said top lip of said housing, and top coupling plate having a first end coupled to said hanger mounting bracket and a second end engaging a top surface of said top lip to couple said hanger mounting bracket to said housing.

5. The lighting assembly of claim 4, wherein said hanger mounting bracket is slidably adjustable along a length of said side wall of said housing.

6. The lighting fixture of claim 4, wherein said top end of said housing has a downwardly projecting lip extending from said top lip to form a hook-shaped end with a recess facing said bottom end of said housing, and said hanger mounting bracket has an upwardly extending flange at the ends thereof to form said hook portion for hooking to said downwardly projecting lip.

7. The lighting assembly of claim 3, wherein said housing further includes a plurality of corner post members coupling said side walls to a respective end wall of said housing, each said corner member having a first leg received in an end of a respective side wall and a second end received in an end of a respective end wall, said side walls and end walls having a tab bent inwardly to engage said legs of said corner members to couple said side walls to said corner members.

8. The lighting assembly of claim 3, wherein said top lip has a downward turned first portion and a second portion extending substantially perpendicular to said side wall to form an upwardly facing recess in a top face of said housing, said second portion extending away from said side walls and inwardly with respect to said housing; and a top wall received in said recess of said housing and coupled to said top lip and overlying said lighting fixture.

9. The lighting assembly of claim 1, wherein said housing includes a top wall closing the top end of said housing.

10. The lighting assembly of claim 1, wherein said coupling bracket is a substantially planar member coupling to a top end of said lighting fixture and where said first tab extends outwardly from said planar member and is received in said slot in said housing.

11. A surface mounted lighting assembly comprising:

a lighting fixture having a top wall, a first end wall, a second end wall, a ballast channel, at least one reflector having a longitudinal downwardly facing edge, and said ballast channel extending between said end walls, top face, and for supporting a lamp base and a lamp for directing light in a downward direction with respect to said lighting fixture, said lighting fixture being a self-contained assembly configured for use as a stand alone recessed lighting fixture; and a housing having a first end wall and a second end wall, a first side wall and a second side wall, said first and second side walls being coupled to said end walls and defining an internal cavity, said side walls and end walls having a top end with an inwardly extending top lip, and a downwardly extending lip coupled to said top lip and having a slot formed therein, a coupling bracket coupled to said top wall of said lighting fixture and having a first tab received in said slot in said end wall for coupling said lighting fixture to said housing, said lighting fixture being positioned within said housing and being coupled thereto for supporting said lighting fixture within the housing.

12. The lighting assembly of claim 11, wherein said side walls of said housing have a bottom end with an inwardly extending bottom lip with an upturned end to define a recessed portion, and where said longitudinal edge of said at least one reflector has an upwardly extending portion and a downwardly extending hook portion received in said recessed portion.

13. The lighting assembly of claim 12, wherein said top lip of said side walls has a second portion extending inwardly from said downwardly extending lip with respect to said housing and defining a recess in said top end; and a top wall received in said recess and coupled to said top lip.

14. The lighting assembly of claim 12, wherein said mounting bracket has a second tab received in said slot in said side wall, and where said first tab and second tab extend substantially perpendicular and substantially parallel to each other.

15. The lighting assembly of claim 12, further comprising a hanger mounting bracket for hanging said lighting assembly and extending between said side walls of said housing, said mounting bracket having a hook-shaped end portion for engaging said downwardly extending lip of said top lip of said side wall and a top coupling plate for engaging a top surface of said lip to couple said mounting hanger bracket to said housing, and where said mounting bracket is slidably adjustable along a longitudinal dimension of said housing.

16. A method of retrofitting a recessed lighting fixture to a surface mount lighting fixture, said method comprising the steps of:

providing a lighting fixture adapted for mounting in a ceiling in a recessed position, said lighting fixture having a top wall, a first end wall, a second end wall, a reflector extending between said first and second end walls, and supporting a lamp holder for receiving a lamp; and positioning said lighting fixture in a housing and coupling a bottom edge of said reflector and said top wall of said lighting fixture to said housing, said housing having a first end wall, a second end wall, a first side wall and a second side wall, said first and second side walls extending between said end walls, said housing having an open top end adapted for surface mounting to a ceiling and an open bottom end, wherein said housing further comprises a hanger mounting bracket having a hooked end coupled to a downwardly facing recess in a top end of a first side wall and a second side wall of said housing for supporting said housing and lighting fixture.

17. The method of claim 16, wherein said lighting fixture includes at least one coupling bracket coupled thereto, said coupling bracket having a first tab and a second tab, and said end walls and side walls having a slot positioned to receive said tabs, said method further comprising inserting said first and second tabs of said coupling member bracket into a respective slot in said housing to couple said lighting fixture to said housing.

* * * * *